US009138763B2

(12) United States Patent
Finstad et al.

(10) Patent No.: US 9,138,763 B2
(45) Date of Patent: Sep. 22, 2015

(54) DUAL MODE PUMP CONTROL

(75) Inventors: Eric J. Finstad, Rogers, MN (US); Michael J. Mansheim, Burnsville, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 486 days.

(21) Appl. No.: 12/991,450

(22) PCT Filed: May 5, 2009

(86) PCT No.: PCT/US2009/042763

§ 371 (c)(1), (2), (4) Date: Nov. 8, 2010

(87) PCT Pub. No.: WO2009/137425

PCT Pub. Date: Nov. 12, 2009

(65) Prior Publication Data

US 2011/0061593 A1 Mar. 17, 2011

Related U.S. Application Data

(60) Provisional application No. 61/051,400, filed on May 8, 2008.

(51) Int. Cl.

| | |
|---|---|
| ***B05C 11/00*** | (2006.01) |
| ***B05B 9/04*** | (2006.01) |
| ***B05B 12/08*** | (2006.01) |
| ***F04B 49/08*** | (2006.01) |
| ***F04B 49/20*** | (2006.01) |

(52) U.S. Cl.

CPC ..... *B05B 9/0403* (2013.01); *B05B 9/0426* (2013.01); *B05B 12/085* (2013.01); *F04B 49/08* (2013.01); *F04B 49/20* (2013.01)

(58) Field of Classification Search

None

See application file for complete search history.

(56) References Cited

U.S. PATENT DOCUMENTS

| | | | | |
|---|---|---|---|---|
| 3,411,673 | A * | 11/1968 | Mann | 222/189.11 |
| 4,355,761 | A | 10/1982 | Bjorn et al. | |
| 4,614,300 | A * | 9/1986 | Falcoff | 239/71 |
| 2004/0009075 | A1* | 1/2004 | Meza et al. | 417/32 |
| 2007/0075163 | A1* | 4/2007 | Smith et al. | 239/124 |
| 2007/0095938 | A1 | 5/2007 | Rioux | |

OTHER PUBLICATIONS

Graco Inc. T-Max 405 Manual showing previous method.

* cited by examiner

*Primary Examiner* — Charles Capozzi

(74) *Attorney, Agent, or Firm* — Kinney & Lange, P.A.

(57) ABSTRACT

A fluid pump control that allows for both flow control and pressure control to allow greater flexibility in applying architectural coatings.

1 Claim, 1 Drawing Sheet

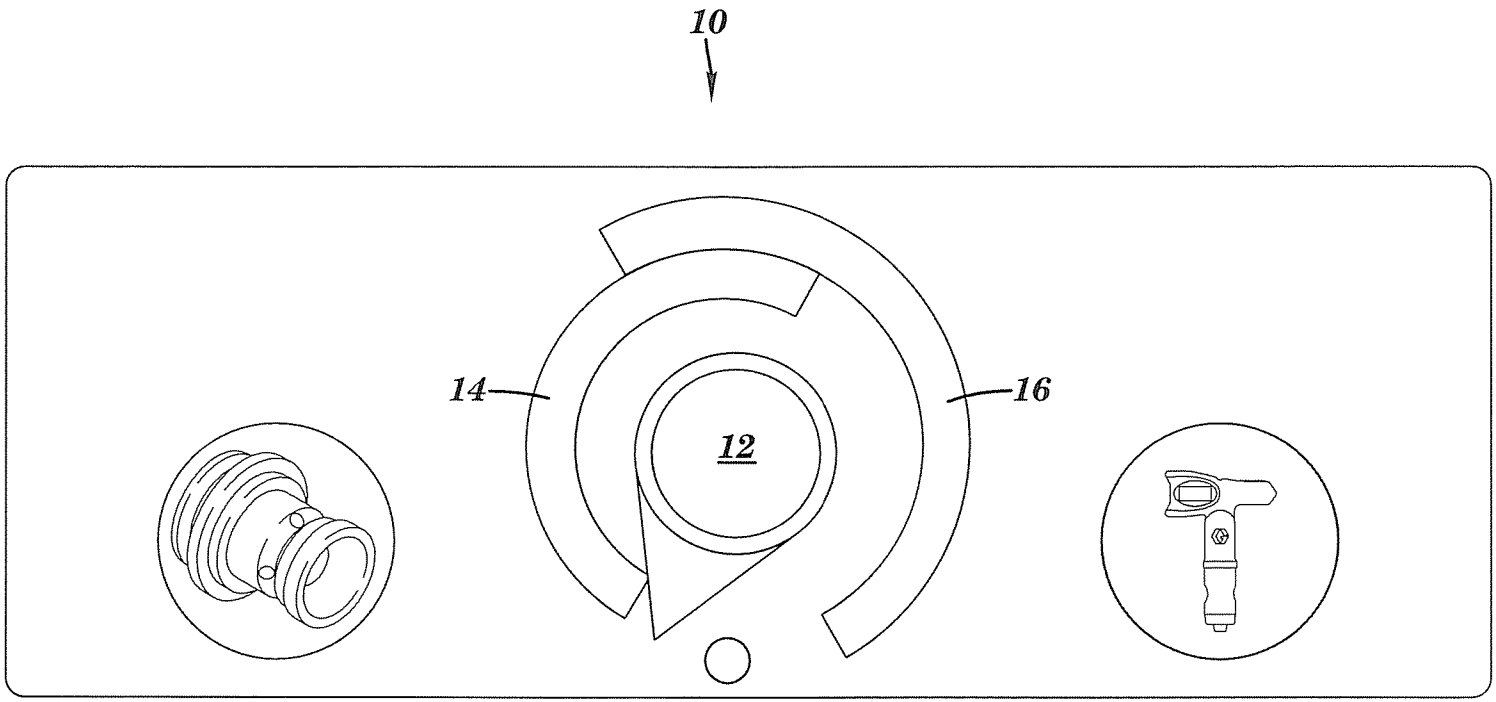
10
16
12
14

DUAL MODE PUMP CONTROL

This application claims the benefit of U.S. Application Ser. No. 61/051,400, filed May 8, 2008, the contents of which are hereby incorporated by reference.

TECHNICAL FIELD

Background Art

Airless spray pumps are well known and conventionally provided with pressure control such that an electric motor drives a reciprocating piston (or other type) pump until the pump output reaches the desired pressure at which point the motor power is reduced or turned off if the pump has stalled—typically when the operator has detriggered the spray gun.

DISCLOSURE OF THE INVENTION

An electronic motor control is used to control an electric motor that drives a pump for applying architectural coatings. The control may be used in one of two different modes—flow control and pressure control. In the flow control mode, the control is used to operate the motor in a constant RPM condition based upon input from the user. In the pressure control mode, the control ensures the motor runs such that the pump is creating constant pressure, based on user input, which is also dependant on flow rate.

The invention allows the user to apply coatings at either constant flow rates or consistent pressure for improved quality of application depending on the material/technique being used to apply the coating.

These and other objects and advantages of the invention will appear more fully from the following description made in conjunction with the accompanying drawings wherein like reference characters refer to the same or similar parts throughout the several views.

BRIEF DESCRIPTION OF DRAWINGS

FIG. 1 shows the pressure control which the operator may use to select and control the desired spray mode.

BEST MODE FOR CARRYING OUT THE INVENTION

An electronic motor control 10 is used to control an electric motor that drives a pump for applying architectural coatings. The control may be used in one of two different modes—flow control and pressure control. In the flow control mode, the control is used to operate the motor in a constant RPM condition based upon input from the user. In the pressure control mode, the control ensures the motor runs such that the pump is creating constant pressure, based on user input, which is also dependant on flow rate.

The invention allows the user to apply coatings at either constant flow rates or consistent pressure for improved quality of application depending on the material/technique being used to apply the coating.

In the flow control mode constant motor RPM is set by the user positioning the potentiometer 12 somewhere in the green zone 14. Motor speed can be adjusted from approximately 10% to 100% of available motor RPM. Initial start up has a fixed safety stall pressure. After approximately 5 seconds of operation, the control "learns" a running pressure and sets a new stall pressure approximately 100 psi above running pressure. The unit stalls at this new pressure when the applicator (spray gun) valve is closed. This new safety stall pressure eliminates spray blast, due to excessive pressure, when the valve is opened again. This mode is most effective when low flow rates are required with large tips, which are typically used when applying texture with air assisted spraying.

In the constant pressure mode, pump pressure is set by user setting the potentiometer 12 somewhere with in the blue zone 16. Pump pressure can be adjusted from set minimum pressure to the maximum working pressure for the system. After approximately 5 seconds of operation, the control learns a constant motor speed that will provide constant pump pressure without starting and stopping the motor. This mode is most effective when small tips are used and is similar to typical airless spraying.

It is contemplated that various changes and modifications may be made to the pump control without departing from the spirit and scope of the invention as defined by the following claims.

The invention claimed is:

1. In an airless sprayer for applying coatings, said sprayer comprising an electric motor, a pump driven by the electric motor to pump a coating material to a spray applicator, and a controller configured to control operation of the electric motor, the improvement comprising said controller configured to be selectable between a flow control mode and a pressure control mode, wherein in said flow control mode, said controller is configured to operate said motor at a selected constant revolutions per minute based upon a flow control mode input from a user for a constant flow rate to determine a running pressure corresponding to the selected constant revolutions per minute, and to set a stall pressure above the running pressure at which the sprayer stalls when a valve of the applicator is closed; and wherein in said pressure control mode, said controller is configured to control said motor to a constant motor speed that will cause said pump to produce a selected constant pump pressure based on a pressure control mode input from the user; and wherein in both said flow control mode and said pressure control mode the controller is configured to control said motor to cause the pump to produce a pressure level that is suitable for airless spraying of coating material from the spray applicator.

* * * * *